US005449968A

United States Patent [19]

Terui et al.

[11] Patent Number: 5,449,968

[45] Date of Patent: Sep. 12, 1995

[54] THERMAL FIELD EMISSION CATHODE

[75] Inventors: Yosinori Terui; Katsuyoshi Tsunoda; Masaru Ide, all of Shibukawa, Japan

[73] Assignee: Denki Kagaku Kogyo Kabushiki Kaisha, Tokyo, Japan

[21] Appl. No.: 80,532

[22] Filed: Jun. 24, 1993

[30] Foreign Application Priority Data

Jun. 24, 1992 [JP] Japan ..... 4-188952

[51] Int. Cl.[6] ..... H01J 27/00

[52] U.S. Cl. ..... 313/362.1; 313/336

[58] Field of Search ..... 313/362.1, 336, 633, 313/341, 345, 346 R, 346 DC, 231.01, 231.51, 111.11, 111.81

[56] References Cited

U.S. PATENT DOCUMENTS

| | | | |
|---|---|---|---|
| 4,324,999 | 4/1982 | Wolfe | 313/346 R |
| 4,325,000 | 4/1982 | Wolfe et al. | 313/336 |
| 4,379,250 | 4/1983 | Hosoki et al. | 313/336 |
| 4,488,045 | 12/1984 | Anazawa et al. | 313/362.1 |
| 4,620,080 | 10/1986 | Arata et al. | 313/231.51 |
| 4,629,931 | 12/1986 | Clark, Jr. et al. | 313/362.1 |
| 4,631,448 | 12/1986 | Tamura et al. | 313/362.1 |
| 4,983,845 | 1/1991 | Liebl | 313/362.1 |
| 4,994,711 | 2/1991 | Matossian | 313/362.1 |
| 5,034,612 | 7/1991 | Ward et al. | 313/336 |

FOREIGN PATENT DOCUMENTS

| | | |
|---|---|---|
| 227643 | 1/1990 | Japan . |
| 2100249 | 4/1990 | Japan . |

OTHER PUBLICATIONS

Wolfe, J. E. Operational Experience with Zirconiated T-F Emitters. Technology Center, Burroughs Corp.: San Diego, Calif., 92127. Sep. 28, 1979. pp. 1704–1708.

*Primary Examiner*—Stephen Brinich

*Attorney, Agent, or Firm*—Oblon, Spivak, McClelland, Maier & Neustadt

[57] ABSTRACT

A thermal field emission cathode comprises a needle-like electrode of single crystal tungsten having an axis direction of <100> provided with a coating layer of zirconium and oxygen; a heater for heating the needle-like electrode; a suppressor electrode; and a supply source for supplying zirconium and oxygen having zirconium of not less than $3.0\times10^{-6}$ g and not more than $10\times10^{-6}$ g by weight to the coating layer disposed on the needle-like electrode in a range between a point apart from a junction of the needle-like electrode and the heater by 200 μm in a direction of a distal end of the needle-like electrode and a plane including an outer surface of the suppressor electrode.

8 Claims, 3 Drawing Sheets

THERMAL FIELD EMISSION CATHODE

BACKGROUND OF THE INVENTION

1. Field of the Invention

The present invention relates to a thermal field emission cathode which is employed in an electron microscope, a critical dimension machine, an electron beam lithograph machine, an electron beam tester and the like.

2. Discussion of Background

In recent times, a thermal field emission cathode has been developed which utilizes a needle-like electrode of single crystal tungsten to provide an electron beam having a higher brightness. In a so-called ZrO/W thermal field emission cathode wherein a tungsten tip (hereinafter W tip) having an axis direction of <100> is provided with a coating layer composed of zirconium and oxygen, and the work function of a (100) surface is selectively lowered from 4.5 eV to 2.8 eV by a ZrO coating layer. Accordingly, compared with a conventional thermionic cathode, the thermal field emission cathode is provided with a high brightness and a long service life, and provided with a characteristic wherein the thermal field emission cathode is more stable and easier to use than a field emission cathode.

FIG. 2 shows a sectional diagram of a thermal field emission cathode. A reference numeral 1 designates a W tip, 2, a suppressor electrode for supplying a voltage to form an electric field which restrains the emission of thermions, 3, a tungsten wire which is a heater for heating the W tip and 4, an insulator. A numeral 5 designates a metal support. Further, FIG. 1 is a diagram magnifying a portion of the W tip 1 and the tungsten wire 3 of FIG. 2. A portion of the W tip is provided with a supply source 7 for supplying zirconium and oxygen. The surface of the W tip is covered with a ZrO coating layer, although not shown.

The W tip 1 of the ZrO/W thermal field emission cathode is heated by the tungsten wire 3 by flowing current in the tungsten wire 3, and is utilized under a temperature of approximately 1,800K. Therefore, the W tip 1 is consumed by evaporation. However, zirconium and oxygen are continuously supplied to the surface of the W tip 1 from the supply source 7 for supplying zirconium and oxygen through a surface diffusion thereby continuously forming the ZrO coating layer. When zirconium or oxygen in the supply source 7 for supplying zirconium and oxygen is exhausted, the formation of the ZrO coating layer is finished, the work function is increased, the function as the thermal field emission cathode is lost and its service life expires.

A conventional method for forming a ZrO coating layer to provide a low work function is shown as follows (U.S. Pat. No. 4,324,999).

First step: Powders of zirconium hydride ($ZrH_2$) as a precursor of a substance including zirconium is added with an organic solvent to thereby form a slurry, and a storage of zirconium hydride is formed by adhering the slurry to the W tip 1 having a direction of <100>.

Second step: Heating of the W tip 1 is performed in a high vacuum, zirconium hydride is decomposed into zirconium and hydrogen, and zirconium is diffused into the W tip 1.

Third step: The W tip 1 is heated in an atmosphere of oxygen of approximately $10^{-6}$ Torr, and a ZrO coating layer is formed on the W tip 1. At the same time, the total quantity of zirconium or a portion thereof is transformed into zirconium oxide and a supply source of zirconium and oxygen is formed (hereinafter, this step is called oxidation treatment).

However, there are several problems in making the ZrO/W thermal field emission cathode by the conventional method.

The first problem in making the ZrO/W thermal field emission cathode by the conventional method is that a variation of the service life is large, the occurrence of failure as in melting and cutting-off of the tungsten wire 3 and the destruction of the W tip 1 by discharge, is high and an unstable behavior of the electron beam is often observed. For instance, when the supply source 7 of zirconium and oxygen is disposed in the vicinity of the W tip 1 on the side of the heater, a temperature thereof is elevated, evaporating rates of zirconium and oxygen are accelerated and the service life is shortened. Especially, in case wherein the oxidation treatment is insufficient and an amount of unoxidized zirconium is large, this effect is significant, since the vapor pressure of zirconium is about fifty times as much as the vapor pressure of oxidized zirconium at 1,800K. Further, when the supply source 7 of zirconium and oxygen is disposed at the junction of the W tip 1 and the tungsten wire 3, or on the tungsten wire, the heating characteristic changes, the heating current is more necessary and the tungsten wire 3 may be molten and cut off in an extreme case.

On the other hand, when the supply source 7 of zirconium and oxygen is disposed in the vicinity of the distal end of the W tip 1, the temperature is low, the evaporation rates are slow, which is preferable in view of the service life. However, this arrangement disturbs an electric field distribution in the vicinity of the distal end of the W tip 1 and an opening of the suppressor electrode 2, or the electron beam becomes unstable, which considerably lowers the function of the electron emission cathode. However, no investigation has been performed with respect thereto.

Further, the second problem is that the supply source of zirconium and oxygen is peeled off from the W tip in the step of making and the product can not be provided. Or, even if the product is provided, the peeling-off is caused in use thereof, which causes an inconvenience wherein the function of the thermal field emission cathode is lost, and the like.

The third problem is that a desired electron beam characteristic is not provided.

FIG. 3 is a schematic diagram showing an electric circuit whereby a thermal field emission cathode is employed. The thermal field emission cathode generates a spatially diverging electron beam. However, in an end use such as an electron microscope, an electron beam $I_p$ 9 at the axis center portion is mainly employed. To provide a quantity of electron beam at this portion, the temperature and the extraction voltage Vex 10 of the thermal field emission cathode are controlled. However, an increase in the extraction voltage increases not only the electron beam $I_p$ 9 at the axis center portion but also the electron beam quantity at the surrounding portion. When the total electron beam quantity is larger than necessary, a large capacity of power supply is necessary for operating the thermal field emission cathode, which is economically disadvantageous. With respect to an already designed and manufactured device employing the thermal field emission cathode, a thermal field emission cathode having a characteristic wherein the electron beam quantity at the surrounding portion is large compared with the electron beam quantity $I_p$ 9 at the axis center portion, can not be employed. Further, when the total electron beam quantity $I_t$ 12 is large, a gas discharge quantity from the electrode material is increased by the electron bombardment effect. Therefore, the electron beam becomes unstable over time and spatially. The electron beam quantity at the surrounding portion or, accordingly, the total electron beam quantity is preferable to be as small as possible, so far as a desired electron beam quantity at the axis center portion can be provided.

SUMMARY OF THE INVENTION

The present invention is performed in view of the above problems, and it is an object of the present invention to provide a thermal field emission cathode which is stable, of which service life is long and which is provided with a low failure ratio and a stable electron beam characteristic.

According to an aspect of the present invention, there is provided a thermal field emission cathode comprising:

a needle-like electrode of single crystal tungsten having an axis direction of <100> provided with a coating layer of zirconium and oxygen;

a heater for heating the needle-like electrode;

a suppressor electrode; and a supply source for supplying zirconium and oxygen having zirconium of not less than $3.0\times10^{-6}$ g and not more than $10\times10^{-6}$ g by weight to the coating layer disposed on the needle-like electrode in a range between a point apart from a junction of the needle-like electrode and the heater by 200 μm in a direction of a distal end of the needle-like electrode and a plane including an outer surface of the suppressor electrode.

In determining the zirconium quantity, the elemental analysis is performed on the W tip portions of the thermal field emission cathodes which are provided by changing a painting quantity of a precursor for the supply source of zirconium and oxygen by a previous experiment, thereby providing a relationship between the painting quantity and the zirconium quantity. Therefore, a desired value of the zirconium quantity can be provided without destructing the thermal field emission cathode.

According to another aspect of the present invention, there is provided the thermal field emission cathode according to the above aspect, wherein a cone angle in a range from the distal end of the needle-like electrode to the first point on the needle-like electrode apart from the distal end by 10 μm is not less than 10° and not more than 25°.

According to another aspect of the present invention, there is provided the thermal field emission cathode according to the above aspect, wherein a cone angle in a range from the distal end of the needle-like electrode to the second point apart from the distal end by 200 μm is not less than 10° and not more than 35°.

According to another aspect of the present invention, there is provided the thermal field emission cathode according to the above aspect, wherein no reaction is caused between the supply source for supplying zirconium and oxygen and the needle-like electrode of single crystal tungsten, or a thickness of a layer in which a reaction is caused between the supply source and the needle-like electrode is not more than 15 μm.

According to another aspect of the present invention, there is provided the thermal field emission cathode according to the above aspect, wherein in a step of forming the coating layer of zirconium and oxygen on the needle-like electrode of single crystal tungsten a heating treatment is performed at a brightness temperature of not less than 1,200° C. and not more than 1,500° C. in a vacuum having a partial pressure of oxygen of not less than $1\times10^{-7}$ Torr.

According to another aspect of the present invention, there is provided the thermal field emission cathode according to the above aspect, wherein a precursor including zirconium dioxide ($ZrO_2$) is employed as the supply source for supplying zirconium and oxygen.

According to another aspect of the present invention, there is provided the thermal field emission cathode according to the above aspect, wherein in a step of forming the coating layer of zirconium and oxygen on the needle-like electrode of single crystal tungsten zirconium is oxidized at a temperature lower than a eutectic temperature of $ZrW_2$ and Zr.

DETAILED DESCRIPTION OF THE PREFERRED EMBODIMENTS

As a factor for controlling the service life of the ZrO/W thermal field emission cathode, the exhaustion of zirconium or oxygen in the supply source of zirconium and oxygen, is pointed out. The rate of consumption by evaporation is considerably dependent on the temperature of the cathode. Further, the position of the supply source of zirconium and oxygen on the needle-like electrode, influences the electric field distribution and the heating characteristic. Therefore, an optimal position is present for the position of the supply source of zirconium and oxygen in consideration of the effects of both. As a result of investigating on this point by the inventors, it has been clarified that there is an optimal range for the location for providing the supply source 7 of zirconium and oxygen, in a range between a point apart from a junction of the W tip 1 and the heater by 200 μm in the direction to the distal end of the W tip, and the outer surface of the suppressor electrode (B in FIG. 1; including both ends).

With respect to a time period wherein zirconium or oxygen in the supply source of zirconium and oxygen is exhausted, the mechanism of consumption is not clarified since there are many unclarified points. However, it has been confirmed that the service life of approximately 5,000 hours can be provided at minimum. When the supply quantity is lower than $3.0\times10^{-6}$ g, the service life is short and an intended product can not be provided. When the supply quantity exceeds $10\times10^{-6}$ g, factors for controlling the service life of the thermal field emission cathode other than the exhaustion of zirconium or oxygen, for instance, the consumption of the heater and the like, are dominant. Therefore, a significant effect can not be expected in view of the service life, and it is difficult to stably paint the supply source on the W tip in making the thermal field emission cathode.

Figure 4:
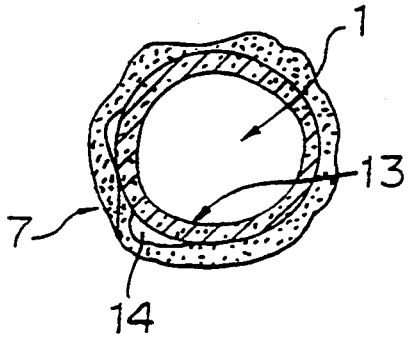
FIG. 4 is a schematic diagram magnifying a section of a W tip with respect to a portion to which a supply source of zirconium and oxygen is adhered.

An investigation has been performed by the inventors on a phenomenon wherein the supply source of zirconium and oxygen is peeled off. It has experimentally found that the phenomenon is caused when the supply source of zirconium and oxygen reacts with the W tip constituting the needle-like electrode and the thickness of the reaction layer exceeds 15 μm. Although the reason has not been clarified, it is considered that zirconium in the supply source of zirconium and oxygen reacts with the W tip by heating in the oxidation treatment step and diffuses to the distal end of the W tip through the reaction layer or the surface of the W tip by itself. FIG. 4 is a schematic diagram showing a section of a portion of the W tip contacting the supply source of zirconium and oxygen of the W tip when the reaction layer is present. In FIG. 4, a numeral 13 designates a reaction layer and 14, a cavity. The reaction product is recognized in a lamellar form. The product is found to be constructed by $ZrW_2$ and Zr. When the reaction layer is present, the reaction product contains $ZrW_2$ and Zr. Therefore, the melting point of the reaction product is lower than that of the W tip. Accordingly, when the reaction layer is thick, the peeling off of the supply source of zirconium and oxygen is caused, since the weight of the supply source of zirconium and oxygen can not be sustained. To prevent this, the oxygen treatment should be performed at a temperature lower than the eutectic temperature (approximately 1,660° C.) of $ZrW_2$ and Zr, that is, zirconium should be oxidized. Further, as the other preventing measure, the condition in the oxidizing treatment should be determined wherein the atmosphere is a vacuum having an oxygen partial pressure of not less than $1\times10^{-7}$ Torr and the brightness temperature is not less than 1,200° C. and not more than 1,500° C.

Further, the supply source of zirconium and oxygen should include a precursor previously provided with zirconium oxide. When the oxygen partial pressure is less than $1\times10^{-7}$ Torr, a time period required for lowering the work function is prolonged, which is not advantageous. With respect to the temperature, when the brightness temperature is less than 1,200° C., a long time period is required for lowering the work function, which is not preferable. When the brightness temperature exceeds 1,500° C., it exceeds the eutectic temperature of $ZrW_2$ and Zr, the formation of the reaction layer is rapidly promoted, the reaction layer becomes thick and the supply source of zirconium and oxygen is apt to be peeled off from the W tip.

As a result of a detailed investigation which has been performed by the inventors, on the problem wherein a thermal field emission cathode having a characteristic wherein the electron beam quantity in the surrounding portion is small as compared with the electron beam quantity at the axis center portion, it has been clarified that the shape of a conical portion of the W tip controls the spatial distribution of the electron beam quantity. Especially, when the shape of the conical portion of the W tip is provided with a straight line or an arcuate form which is concave to the inner portion of the W tip in a range from a point apart from the distal end by 10 μm to a point apart from the distal end by 200 μm, the total electron beam quantity is little dependent on the curvature of the distal end, which can be a solution for the above problem. It is predicted that the reason is that the electron beam at the surrounding portion is emitted by the thermal field emission from the conical portion. It is preferable that with respect to the shape of the conical portion of the W tip, the cone angle in a range from the distal end to a point apart from the distal end by 10 μm, is not less than 10° and not more than 25°. When the cone angle is less than 10°, the manufacturing of the W tip is difficult, the shape of the distal end is easy to deform in the long period of usage and the long-range stability of the electron beam is not provided, which is not preferable. Further, when the cone angle exceeds 25°, the total electron beam quantity is enlarged, which is practically of no value. Concerning the shape of the conical portion of the W tip, in addition thereto, it is preferable that the cone angle in a range from the distal end to a point apart from the distal end by 200 μm, is not less than 10° and not more than 35°. The reason of the numerical limitation is that as mentioned above, when the cone angle is less than 10°, the manufacturing difficulty is increased and the long period of service life can not be achieved, whereas, when the cone angle exceeds 35°, the total electron beam quantity is too large to have a practical value.

EXAMPLE AND COMPARATIVE EXAMPLE

A specific explanation will be given of an embodiment of the present invention in reference to the drawings as follows.

Figure 1:
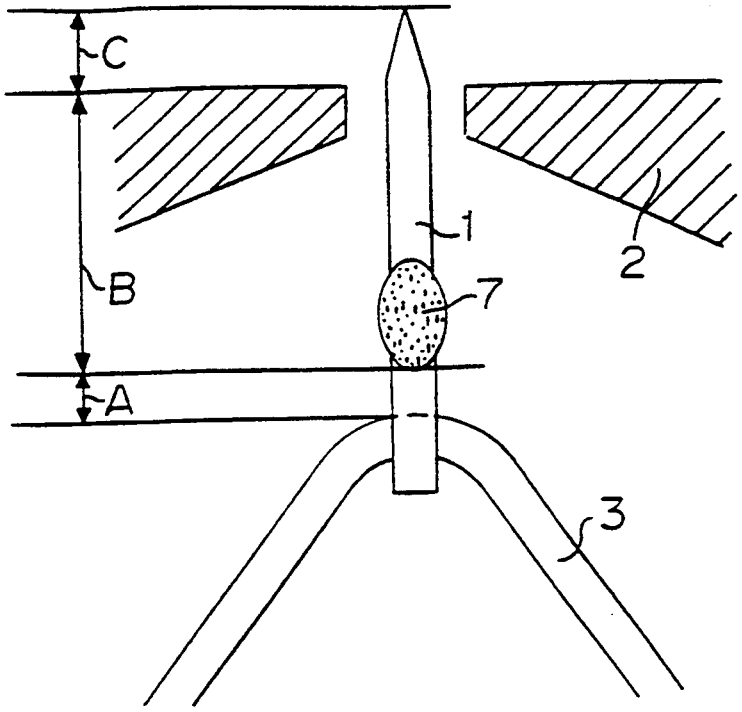
FIG. 1 is a magnified diagram showing the construction of a needle-like electrode and a suppressor electrode of a thermal field emission cathode according to the present invention.
Figure 2:
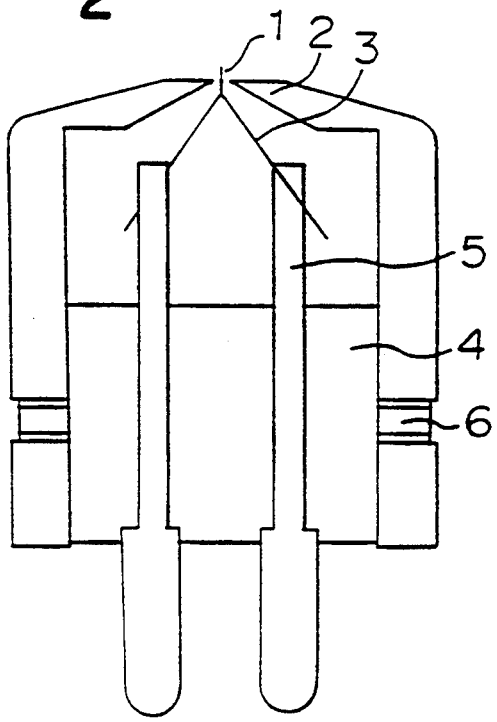
FIG. 2 is a sectional diagram of a thermal field emission cathode.
Figure 3:
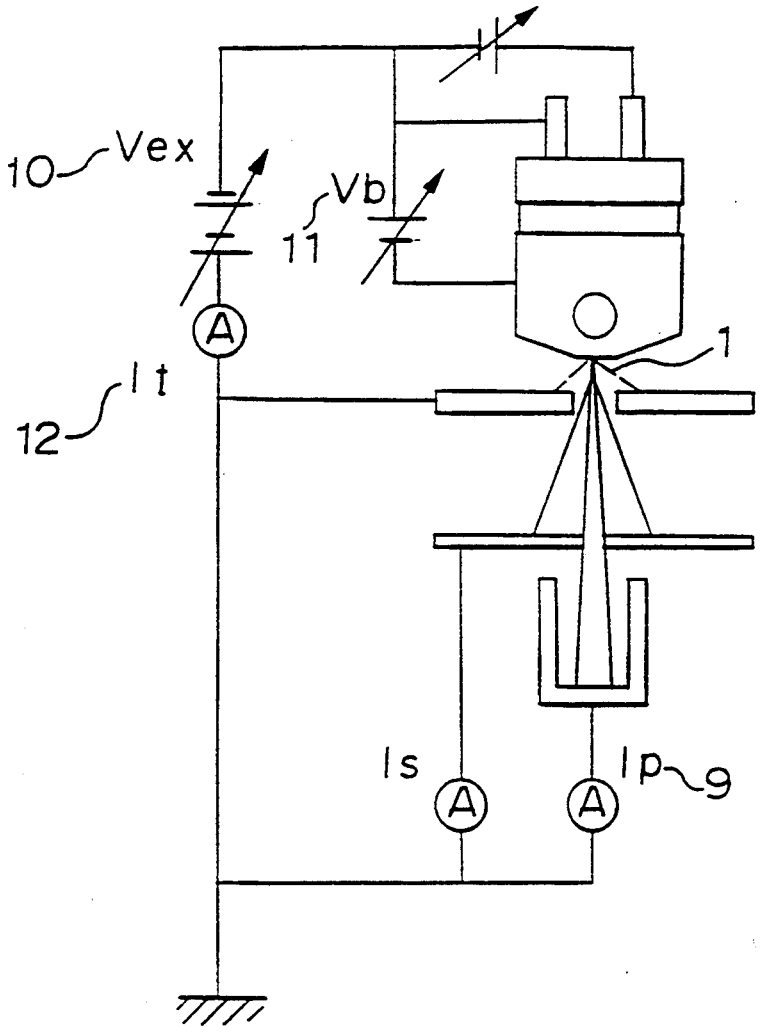
FIG. 3 is an electric circuit diagram when a thermal field emission cathode is employed.
Figure 5:
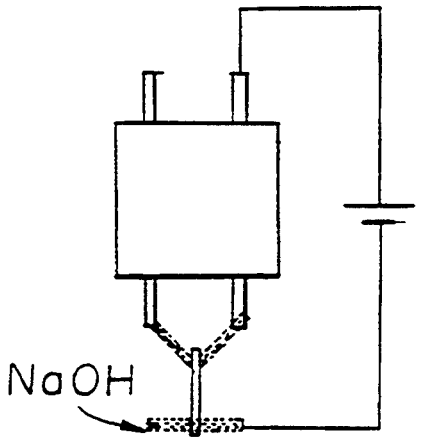
FIG. 5 is a schematic diagram showing a method of performing an electrolytic polishing on a distal portion of a W tip.

As shown in FIG. 1, a single crystal tungsten having a length of 1.2 mm and a direction of <100> is welded to a heater of tungsten wire, and a W tip is formed of which distal end of the single crystal tungsten is polished by the electrolytic polishing method whereby the curvature of the distal end is from 0.3 to 0.5 μm. As shown in FIG. 5, the electrolytic polishing was performed by immersing the distal end of the W tip in an electrolytic solution of NaOH, in application of a DC voltage of 6 V, wherein a ring electrode of stainless steel was a cathode and the W tip was an anode. At this moment, samples of the W tips having different shapes of their conical portions were prepared by controlling the vertical motion of the W tip.

Next, a precursor of a supply source of zirconium and oxygen wherein zirconium hydride powders having particle size of 0.5 μm to 5 μm added with isoamyl acetate in a slurry form, was painted on the W tip by a brush. As a part of experiment, a sample wherein the zirconium hydride powders were added with zirconium oxide such that the zirconium quantity in zirconium oxide was 50% in molar fraction, was prepared. With respect to the position for painting the precursor, the locations were A, B and C apart from a point for welding the W tip 1 and the tungsten wire 3 in the direction of the distal end, as mentioned below (FIG. 1). Normally, the length of the needle-like electrode up to its distal end is approximately 1,000 to 1,500 μm and the length of B is approximately 900 μm. A, B and C are defined as follows.

A: A range (which does not include the both end portions) from the welded point of the W tip 1 and the tungsten wire 3 to a point of the W tip 1 apart from the welded point by 200 μm in the direction of the distal end.

B: A range from the point of the W tip 1 apart from the welded point of the W tip 1 and the tungsten wire 3 by 200 μm in the direction of the distal end, to a plane including an outer surface of the suppressor electrode 2 (which includes the both end portions. This is a range wherein the supply source of zirconium and oxygen is not protruded outside of the outer surface of the suppressor electrode).

C: A range protruding outside of the outer surface of the suppressor electrode 2.

The length of the painted region 7 (the supply source of zirconium and oxygen) is provided with a length of about 300 μm in the longitudinal direction of the W tip 1. After isoamyl acetate was completely evaporated, the suppressor electrode 2 was installed and the distal end of the W tip was controlled such that the distal end was protruded by 300 μm from the outer surface of the suppressor electrode 2. Thereafter, a vacuum of $1\times10^{-9}$ to $1\times10^{-10}$ Torr was created by pumping, the W tip was heated by flowing electric current in the tungsten wire 3, zirconium hydride was decomposed into hydrogen and zirconium at the brightness temperature of 1,200° to 1,550° C., and zirconium was diffused to the surface of the W tip. Next, the oxidation treatment was performed by introducing oxygen and by maintaining the sample under the oxygen partial pressure of $1\times10^{-9}$ to $1\times10^{-5}$ Torr for a time period of 20 hours. In making the above thermal field emission cathodes, a total of 27 kinds of thermal field emission cathodes were prepared which were different in the kind of the precursor and the zirconium weight of the supply source of zirconium and oxygen, the painted location, the oxidation treating condition and the electrolytic polishing condition, and their characteristics were compared.

The prepared 27 kinds of thermal field emission cathodes were heated to the brightness temperature of 1,400° C. under a vacuum of $1.0\times10^{-10}$ Torr, a voltage of 4 kV was applied thereon and their electron beam characteristics were compared and evaluated.

Further, the shapes of the distal portions were observed by a SEM. With respect to a part of the samples, the junction of the supply source of zirconium and oxygen and the W tip was cut and its face was observed. The results are shown in Tables 1 and 2.

TABLE 1

| Test No. | Electrolytic polishing condition | Zirconium & oxygen supply source: Kind of precursor | Position | Zirconium quantity ($\times 10^{-6}$ g) | Oxidation treating condition: Brightness temperature (°C.) | Oxygen partial pressure (Torr) | Peeling-off of zirconium & oxygen supply source | Curvature of distal end (μm) | Life time (hour) | Remarks |
|---|---|---|---|---|---|---|---|---|---|---|
| 1 | Vertical driving | Zirconium hydride | B | 3 | 1400 | $3\times10^{-6}$ | No peeling off | 0.35 | 7500 | — |
| 2 | Vertical driving | Zirconium hydride | B | 6 | 1400 | $3\times10^{-6}$ | No peeling off | 0.35 | 8800 | — |
| 3 | Vertical driving | Zirconium hydride | B | 1 | 1400 | $3\times10^{-6}$ | No peeling off | 0.35 | 4200 | Comparative Example |
| 4 | Vertical driving | Zirconium hydride | A | 1 | 1400 | $3\times10^{-6}$ | No peeling off | 0.35 | 2400 | Comparative Example |
| 5 | Vertical driving | Zirconium hydride | A | 3 | 1400 | $3\times10^{-6}$ | No peeling off | 0.35 | 3700 | Comparative Example |
| 6 | Vertical driving | Zirconium hydride | A | 6 | 1400 | $3\times10^{-6}$ | No peeling off | 0.35 | 3900 | Comparative Example |
| 7 | Vertical driving | Zirconium hydride | C | 1 | 1400 | $3\times10^{-6}$ | No peeling off | 0.35 | Discharge, unstable operation | Comparative Example |
| 8 | Vertical driving | Zirconium hydride | C | 3 | 1400 | $3\times10^{-6}$ | No peeling off | 0.35 | Discharge, unstable operation | Comparative Example |
| 9 | vertical driving | Zirconium hydride | C | 6 | 1400 | $3\times10^{-6}$ | No peeling off | 0.35 | Discharge, unstable operation | Comparative Example |

TABLE 2

| Test No. | Electrolytic polishing condition | Zirconium & oxygen supply source: Kind of precursor | Position | Zirconium quantity ($\times 10^{-6}$ g) | Oxidation treating condition: Brightness temperature (°C.) | Oxygen partial pressure (Torr) | Peeling-off of zirconium & oxygen supply source | Curvature of distal end (μm) |
|---|---|---|---|---|---|---|---|---|
| 10 | Vertical driving | Zirconium hydride | B | 3 | 1400 | $1\times10^{-7}$ | No peeling off | 0.30 |
| 11 | Vertical driving | Zirconium hydride | B | 3 | 1400 | $5\times10^{-7}$ | No peeling off | 0.30 |
| 12 | Vertical driving | Zirconium hydride | B | 3 | 1400 | $1\times10^{-6}$ | No peeling off | 0.32 |
| 13 | Vertical driving | Zirconium hydride | B | 3 | 1200 | $1\times10^{-6}$ | No peeling off | 0.33 |
| 14 | Vertical driving | Zirconium hydride | B | 3 | 1400 | $5\times10^{-6}$ | No peeling off | 0.37 |
| 15 | Vertical driving | Added with oxidized zirconium | B | 3 | 1400 | $1\times10^{-6}$ | No peeling off | 0.38 |
| 16 | Vertical driving | Zirconium hydride | B | 3 | 1400 | $1\times10^{-5}$ | No peeling off | 0.43 |
| 17 | Vertical driving | Zirconium hydride | B | 3 | 1500 | $1\times10^{-6}$ | No peeling off | 0.47 |

TABLE 2-continued

| | | | | | | | | |
|---|---|---|---|---|---|---|---|---|
| 18 | No vertical driving | Zirconium hydride | B | 3 | 1400 | $1 \times 10^{-7}$ | No peeling off | 0.30 |
| 19 | Vertical driving | Zirconium hydride | B | 3 | 1400 | $1 \times 10^{-6}$ | No peeling off | 0.30 |
| 20 | No vertical driving | Zirconium hydride | B | 3 | 1400 | $1 \times 10^{-6}$ | No peeling off | 0.32 |
| 21 | No vertical driving | Zirconium hydride | B | 3 | 1400 | $5 \times 10^{-6}$ | No peeling off | 0.33 |
| 22 | Vertical driving | Zirconium hydride | B | 3 | 1400 | $1 \times 10^{-7}$ | No peeling off | 0.35 |
| 23 | No vertical driving | Zirconium hydride | B | 3 | 1400 | $1 \times 10^{-6}$ | No peeling off | 0.35 |
| 24 | No vertical driving | Zirconium hydride | B | 3 | 1400 | $5 \times 10^{-6}$ | No peeling off | 0.42 |
| 25 | No vertical driving | Zirconium hydride | B | 3 | 1400 | $1 \times 10^{-6}$ | No peeling off | 0.50 |
| 26 | No vertical driving | Zirconium hydride | B | 3 | 1100 | $1 \times 10^{-6}$ | No peeling off | 0.35 |
| 27 | No vertical driving | Zirconium hydride | B | 3 | 1400 | $9 \times 10^{-8}$ | No peeling off | 0.33 |

| Test No. | Conical shape at distal end | Conical angle from distal end to 10 μm (°) | Conical angle from distal end to 200 μm (°) | Total electron beam quantity (Total current) (μA) | Thickness of reaction layer at Zr & $O_2$ supply source (μm) |
|---|---|---|---|---|---|
| 10 | Bent to inner portion | 19 | 22 | 130 | 8 |
| 11 | Bent to inner portion | 15 | 19 | 150 | 9 |
| 12 | Bent to inner portion | 18 | 20 | 150 | 11 |
| 13 | Bent to inner portion | 19 | 22 | 150 | 7 |
| 14 | Bent to inner portion | 16 | 21 | 140 | 10 |
| 15 | Straight line | 19 | 19 | 150 | 0 |
| 16 | Bent to inner portion | 20 | 23 | 160 | 13 |
| 17 | Straight line | 24 | 24 | 160 | 15 |
| 18 | Bent to inner portion | 31 | 19 | 190 | 9 |
| 19 | Convex to outside | 20 | 18 | 200 | 10 |
| 20 | Convex to outside | 28 | 19 | 180 | 8 |
| 21 | Convex to outside | 26 | 18 | 200 | 13 |
| 22 | Convex to outside | 24 | 19 | 240 | 7 |
| 23 | Bent to inner portion | 19 | 37 | 290 | 11 |
| 24 | Convex to outside | 27 | 19 | 230 | 14 |
| 25 | Bent to inner portion | 24 | 36 | 280 | 13 |
| 26 | Convex to outside | 24 | 21 | N.D | — |
| 27 | Convex to outside | 27 | 19 | N.D | — |

Based on the above experimental result, it has been found that the thermal field emission cathode of which supply source of zirconium and oxygen which is disposed in a range B, from the location on the W tip apart from the junction of the W tip and the heater by 200 μm in the distal end direction to the outer surface of the suppressor electrode, is capable of maintaining a stable operation without discharge, and especially, a long service life of not less than 7,000 hours is provided by selecting the zirconium weight in the supply source of zirconium and oxygen to be not less than $3.0 \times 10^{-6}$ g and not more than $10 \times 10^{-6}$ g.

In addition thereto, when the contour of the conical portion is a straight line or in a arcuate shape which is concave to the inner portion of the electrode in a range from a point of the needle-like electrode apart from the distal end by 10 μm to a point apart from the distal end by 200 μm, the total electron beam quantity is not considerably influenced by the curvature of the distal end. Therefore, the power source does not need to be enlarged even when the curvature of the distal end is small. Further, a problem is not apparently caused wherein, the supply source of zirconium and oxygen is peeled off and the thermal field emission cathode is not provided, when the reaction between the supply source of zirconium and oxygen and the tungsten needle-like electrode is not present, or the thickness of the reaction layer is not more than 15 μm.

According to the thermal field emission cathode of this invention, since the supply source of zirconium and oxygen of the needle-like electrode is disposed at the pertinent position, the stable electron beam characteristic having no discharge phenomenon is provided, the service life is prolonged, and the effect in employing the thermal field emission cathode in an electron microscope, an electron beam lithograph machine and the like is considerable.

What is claimed is:

1. A thermal field emission cathode comprising:

a needle-like electrode of single crystal tungsten having an axis direction of <100> provided with a coating layer of zirconium and oxygen;

a heater for heating the needle-like electrode;

a suppressor electrode; and a supply source for supplying zirconium and oxygen having zirconium of not less than $3.0 \times 10^{-6}$ g and not more than $10 \times 10^{-6}$ g by weight to the coating layer disposed on the needle-like electrode in a range between a point apart from a junction of the needle-like electrode and the heater by 200 μm in a direction of a distal end of the needle-like electrode and a plane including an outer surface of the suppressor electrode.

2. The thermal field emission cathode according to claim 1, wherein a cone-shaped contour of the needle-like electrode in a range between a first point on the needle-like electrode apart from the distal end of the needle-like electrode by 10 μm and a second point apart therefrom by 200 μm is a straight line or in an arcuate form convex to the inner side of the needle-like electrode.

3. The thermal field emission cathode according to claim 2, wherein a cone angle in a range from the distal end of the needle-like electrode to the first point on the needle-like electrode apart from the distal end by 10 μm is not less than 10° and not more than 25°.

4. The thermal field emission cathode according to claim 3, wherein a cone angle in a range from the distal end of the needle-like electrode to the second point apart from the distal end by 200 μm is not less than 10° and not more than 35°.

5. The thermal field emission cathode according to claim 1, wherein no reaction is caused between the supply source for supplying zirconium and oxygen and the needle-like electrode of single crystal tungsten, or a thickness of a layer in which a reaction is caused between the supply source and the needle-like electrode is not more than 15 μm.

6. The thermal field emission cathode according to claim 5, wherein in a step of forming the coating layer of zirconium and oxygen on the needle-like electrode of single crystal tungsten a heating treatment is performed at a brightness temperature of not less than 1,200° C. and not more than 1,500° C. in a vacuum having a partial pressure of oxygen of not less than $1\times10^{-7}$ Torr.

7. The thermal field emission cathode according to claim 5, wherein a precursor including zirconium dioxide ($ZrO_2$) is employed as the supply source for supplying zirconium and oxygen.

8. The thermal field emission cathode according to claim 5, wherein in a step of forming the coating layer of zirconium and oxygen on the needle-like electrode of single crystal tungsten zirconium is oxidizing said coating layer at a temperature lower than a eutectic temperature of $ZrW_2$ and Zr.

* * * * *